US006684611B2

(12) United States Patent
Cassoli

(10) Patent No.: US 6,684,611 B2
(45) Date of Patent: Feb. 3, 2004

(54) PLANT FOR PACKAGING AND BAGGING ROLLS OF PAPER

(75) Inventor: Stefano Cassoli, Bologna (IT)

(73) Assignee: Casmatic SpA, Bologna (IT)

( * ) Notice: Subject to any disclaimer, the term of this patent is extended or adjusted under 35 U.S.C. 154(b) by 0 days.

(21) Appl. No.: 10/178,552

(22) Filed: Jun. 25, 2002

(65) Prior Publication Data

US 2003/0079447 A1 May 1, 2003

(30) Foreign Application Priority Data

Oct. 26, 2001 (IT) ..... TO2001A1032

(51) Int. Cl.[7] ..... B65B 35/30
(52) U.S. Cl. ..... 53/537; 53/174; 53/247
(58) Field of Search ..... 53/537, 543, 171, 53/174, 247

(56) References Cited

U.S. PATENT DOCUMENTS 3,954,165 A * 5/1976 Snyder ..... 53/543
4,541,227 A * 9/1985 Coad et al. ..... 53/531
4,679,379 A 7/1987 Cassoli
4,875,328 A * 10/1989 Meyer ..... 53/247
4,939,891 A * 7/1990 Podini ..... 53/247
5,732,536 A * 3/1998 Lin et al. ..... 53/247
5,787,680 A * 8/1998 Tisma et al. ..... 53/247

FOREIGN PATENT DOCUMENTS

DE 19945386 A * 4/2001 ..... B65B/5/06
GB 2 295 597 A 6/1996
JP 02127207 A * 5/1990 ..... B65B/5/06

* cited by examiner

*Primary Examiner*—Stephen F. Gerrity
(74) *Attorney, Agent, or Firm*—Sughrue Mion, PLLC

(57) ABSTRACT

Plant for packaging comprising, a packaging and bagging rolls of paper, includes a packaging machine (12) designed to produce packs of rolls with a pre-set sequence and a bagging machine (12) and to arrange them according to a plurality of layers, each of which is made up of one or more rows of packs, and to insert said layers into a partially formed bag which is closed after the layers have been inserted. Set between the packaging machine (12) and the bagging machine (16) is a conveying assembly (14) which operates in a cadenced way together with the packaging machine (12) and the bagging machine (16).

1 Claim, 6 Drawing Sheets

PLANT FOR PACKAGING AND BAGGING ROLLS OF PAPER

BACKGROUND OF THE INVENTION

The present invention relates to a plant for packaging and bagging rolls of paper. The present invention has been developed with reference to the sector of packaging of rolls of toilet paper and kitchen wipes. Traditional packaging and bagging plants envisage the use of two independent machines connected together in series by means of a conveying system which also performs the function of accumulator or storage unit. The machine upstream is a packaging machine in which the rolls to be packaged, which advance along one or more continuous lines, are fed to an assembly for formation of the packs, in which, at each cycle, a pre-set number of rolls are wrapped in a film of packaging material which is folded and sealed by welding around the rolls so as to form a pack. From the output section of the packaging machine, the packs are transported to a bagging machine, in which the individual packs are arranged in one or more rows which can be set on top of one another to form two or more layers. In the bagging machine, the packs arranged according to a pre-set number of rows and layers are inserted into a bag of packaging material, which is sealed after insertion of the packs.

In traditional solutions, the packaging machine and the bagging machine are provided with respective controllers which are independent of one another and operate according to substantially independent time sequences. The conveyor set between the packaging machine and the bagging machine takes up a considerable amount of space and has the purpose of constituting an accumulator that enables separation of the operating sequences of the two machines cascaded together.

The major drawback of the solution according to the prior art lies in the large amount of space that it is necessary to provide for the conveyor-accumulator which is set between the packaging machine and the bagging machine.

SUMMARY OF THE INVENTION

The purpose of the present invention is to provide a plant which is simple and functional and which will enable the aforesaid drawback to be overcome.

BRIEF DESCRIPTION OF THE DRAWINGS

According to the present invention, the above purpose is achieved by a plant having the characteristics that form the subject of the main claim.

The characteristics and advantages of the present invention will emerge clearly from the ensuing detailed description, provided purely by way of non-limiting example in which.

DETAILED DESCRIPTION OF THE INVENTION

Figure 1:
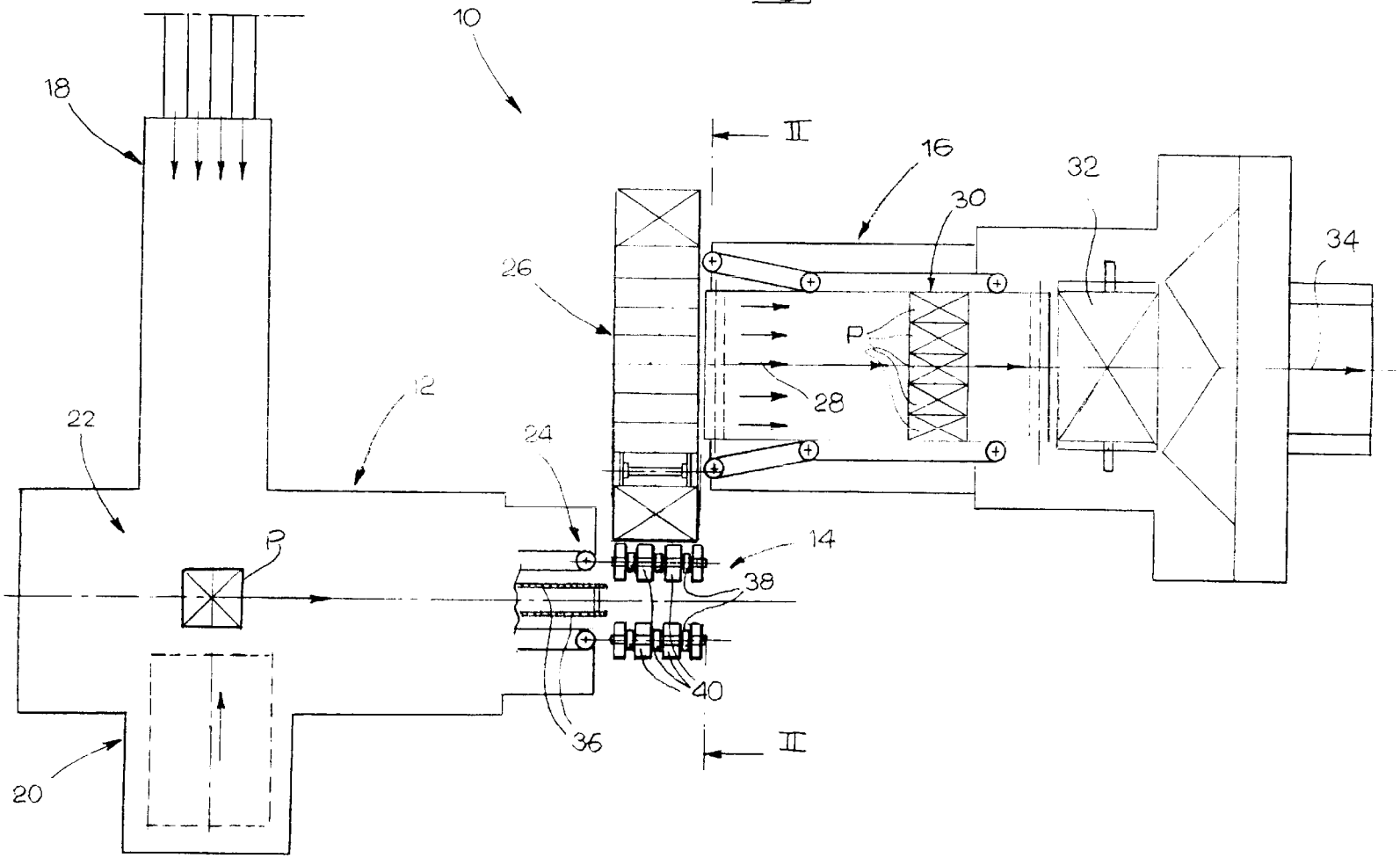
FIG. 1 is a plan view of a first embodiment of a plant according to the present invention.

With reference to FIG. 1, number 10 designates a plant for packaging and bagging rolls of paper. The plant 10 comprises a packaging machine 12, a conveying assembly 14, and a bagging machine 16 which are set in series.

The packaging machine 12 and bagging machine 16 are built in a way in itself known, according to criteria consolidated in the sector of packaging of rolls of paper. For the purposes of the present invention it will suffice to note that the packaging machine 12 comprises a feed assembly 18 along which the rolls of paper that are to be packaged advance along one or more continuous rows, a feed assembly 20 for feeding films of packaging material, and an assembly 22 for the formation of packs. The assembly 22 is made in such a way that it wraps a portion of film of plastic material around one or more rolls. Inside the pack-formation assembly 22 there are provided folding means for folding the film around one or more rolls and sealing means for closing the pack by welding overlapping flaps. The reference number 24 designates the output section of the packaging machine 12, from which the finished packs exit according to a pre-set sequence. The packs at output from the packaging machine 12 are picked up by the conveying assembly 14 which operates in a way cadenced with the bagging machine 16. In what follows, some alternative embodiments of the conveying assembly 14 will be described. Generally speaking, the conveying assembly 14 operates under the control of a controller which manages in a synchronized way the operating sequences both of the packaging machine 12 and of the bagging machine 16. In practice, the conveying assembly 14 constitutes a synchronizing device that connects together in a cadenced way the packaging machine 12 and the bagging machine 16. Consequently, instead of forming a storage unit between the output of the packaging machine 12 and the intake of the bagging machine 16, a device is provided that operates under the control of a programme for synchronizing together the operating sequences of the two machines. From the standpoint of the general operation of the plant 10, the packs that pass through the conveying assembly 14 are fed to the bagging machine 16 at a pre-set rate, which is synchronized with the output rate of the packs from the packaging machine 12. The packs transferred in a cadenced way by the conveying assembly 14 are received by a paddle conveyor 26 provided with step-like motion, which forms a row made up of a pre-set number of packs. When the conveyor 26 has received the pre-set number of packs, an extractor device causes the row of packs to advance in the direction indicated by the arrows 28. The reference number 30 designates a row made up of five packs. According to an operating sequence in itself known, successive rows of packs 30 are fed to an elevator device 32, on which one or more layers are formed, each of which consists of one or more rows of packs. The packs arranged according to a pre-set number of rows and layers are inserted inside a partially closed bag, and the bag is then definitively closed and expelled in the direction indicated by the arrow 34 in FIG. 1.

As has already been said previously, the structure and operation of the packaging machine 12 and of the bagging machine 16 have not been described in detail in so far as they are in themselves known.

Figure 2:
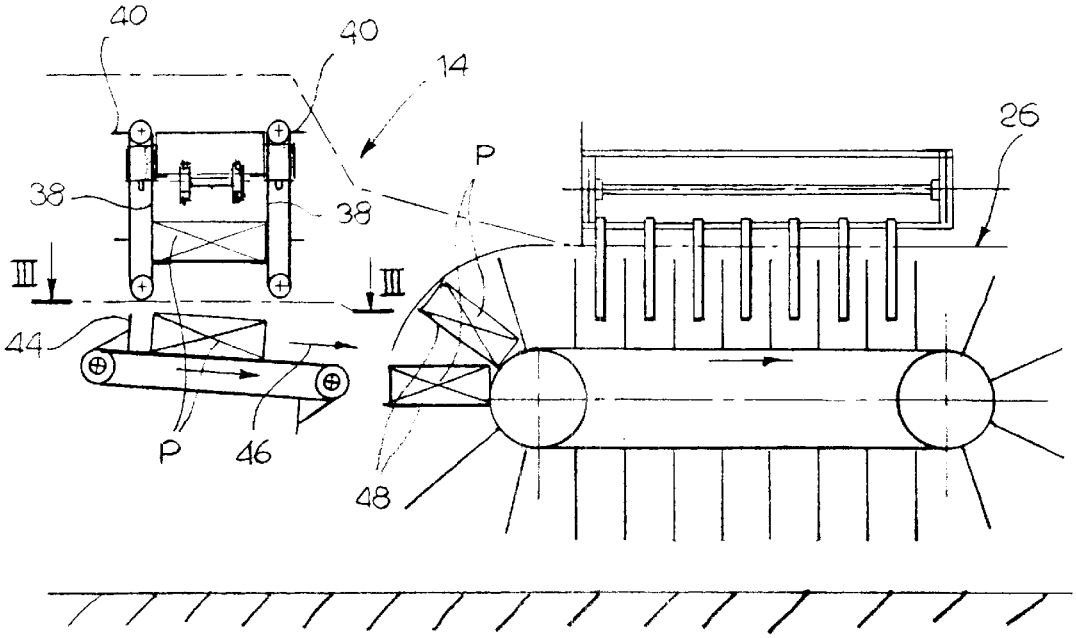
FIG. 2 is a schematic cross-sectional view according to the line II—II of FIG. 1.
Figure 3:
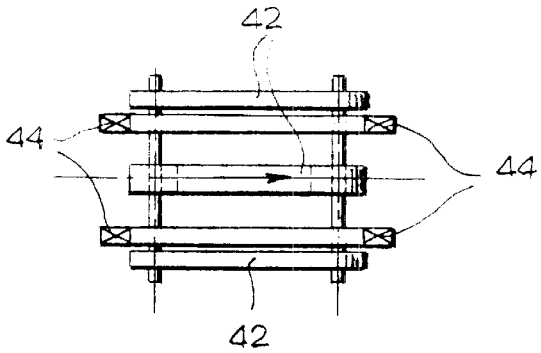
FIG. 3 is a cross-sectional view according to the line III—III of FIG. 2.

FIGS. 1, 2 and 3 illustrate a first embodiment of the conveying assembly 14. The individual packs advance along the output section 24 of the packaging machine 14 accompanied by belts and/or chains 36 which have projections co-operating with the packs so as to guarantee sequential output of said packs according to a pre-set rate. The conveying assembly 14 comprises two series of opposed belts 38 which extend in the vertical direction. The packs that come out of the output section 24 of the packaging machine 12 are supported by tabs 40 mounted on two counter-rotating shafts. During rotation of the tabs 40, each pack drops downwards and is taken up by the belts 38, which convey it downwards, as schematically illustrated in FIG. 2. The movement of the tabs 40 of the conveyor 14 is synchronized with the movement of advance of the packs in the output section 24 of the packaging machine 12. With reference to FIG. 2, the packs P that are conveyed downwards by the belts 38 are deposited on a conveyor 42 provided with pushing elements 44 designed to push the individual packs in the direction indicated by the arrow 46, towards a seat defined between two adjacent paddles 48 of the paddle conveyor 26 provided with step-like motion. The movement of the pushing elements 44 of the conveyor 14 is synchronized with the step-like motion of the paddle conveyor 26 in such a way that loading of each pack P into a seat of the paddle conveyor 26 will take place during the stage in which the paddle conveyor 26 is stationary. After receiving a pack P, the paddle conveyor 26 moves on a step, so as to bring a free seat into a position corresponding to the conveyor 42.

Figure 5:
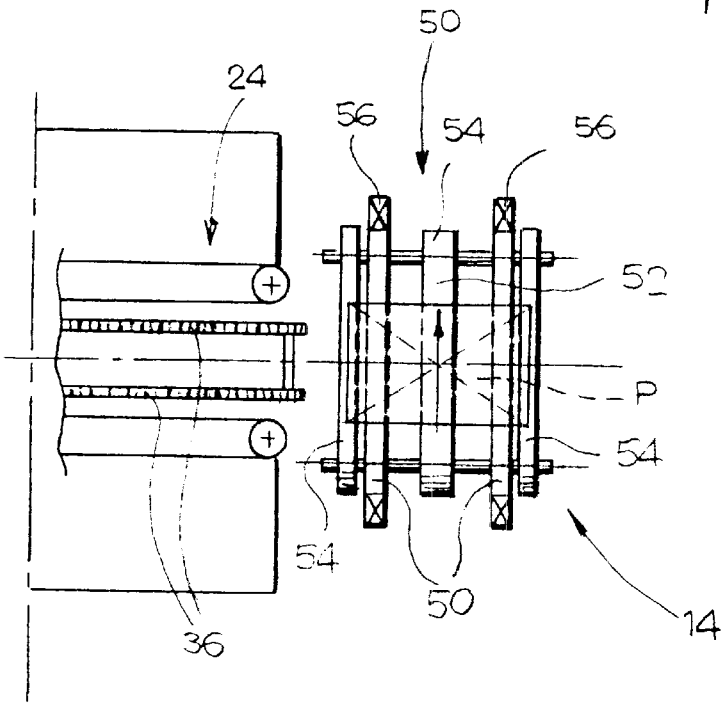
FIG. 5 is a schematic cross-sectional view according to the line V—V of FIG. 4.
Figure 4:
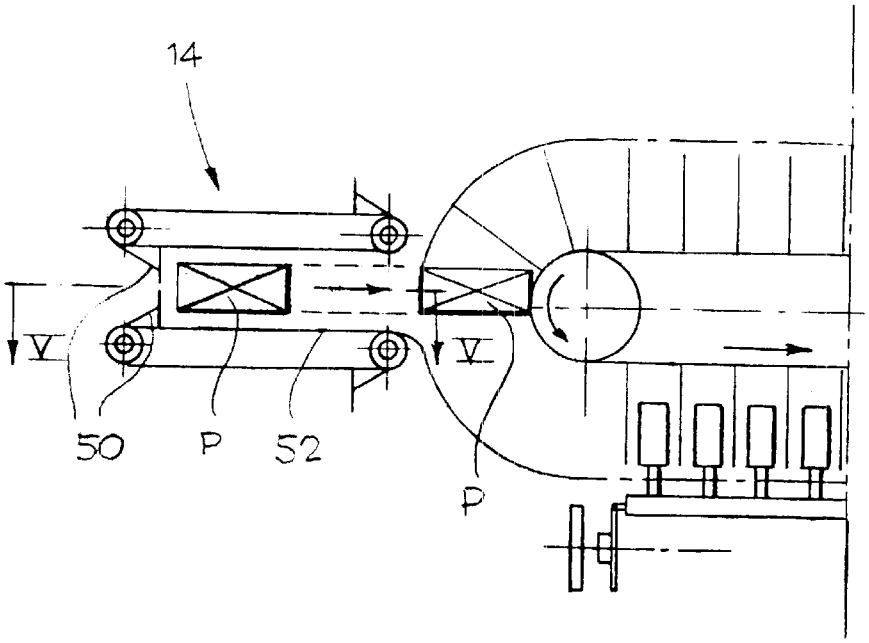
FIG. 4 is a view similar to that of FIG. 2, illustrating a second embodiment of the present invention.

In the variant illustrated in FIGS. 4 and 5, the conveying assembly 14 comprises a single conveyor which receives the packs P from the output section 24 and transfers them to the paddle conveyor 26 in a way cadenced with the step-like motion of the latter. In the embodiment of FIGS. 4 and 5, the conveying assembly 14 is provided with pushing elements 50, the movement of which is controlled by a programme and which are designed to push the packs P in the direction indicated by the arrow 52. With reference to FIG. 5, the conveying assembly 14 may, for example, be made up of a surface for sliding of the packs P, which is formed by slats 54, and of two circuits set on top of one another of belts or chains 56 that carry the phased pushing elements 50.

Figure 6:
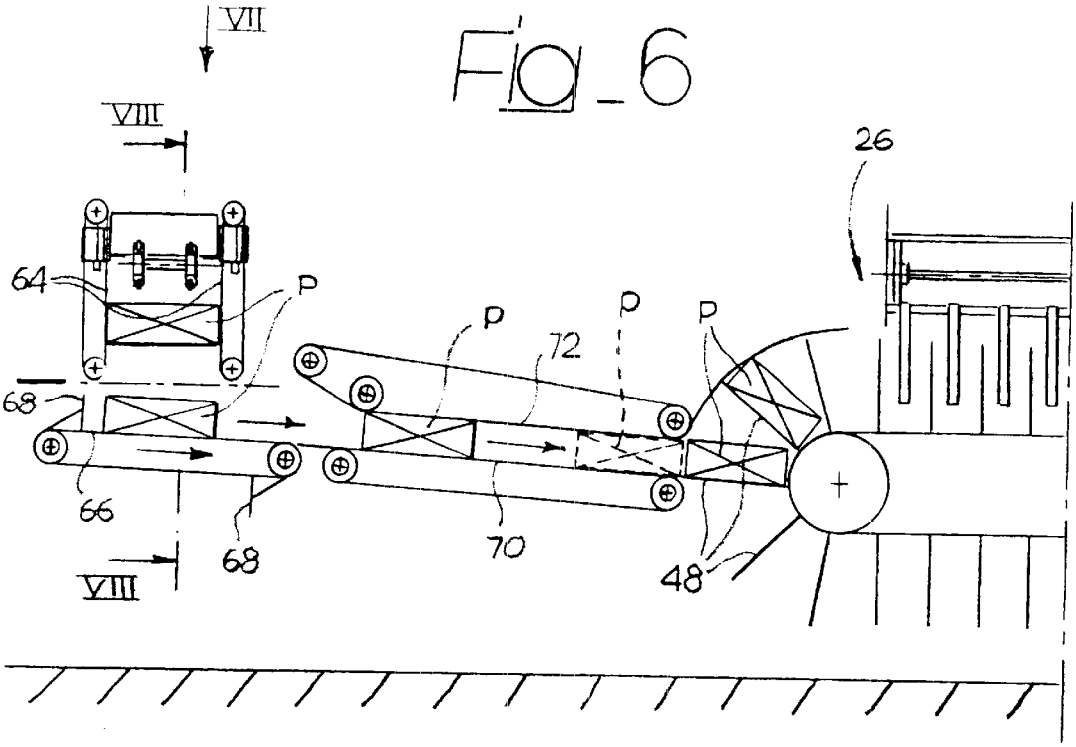
FIG. 6 is a view similar to that of FIG. 2, illustrating a third embodiment of the present invention.
Figure 8:
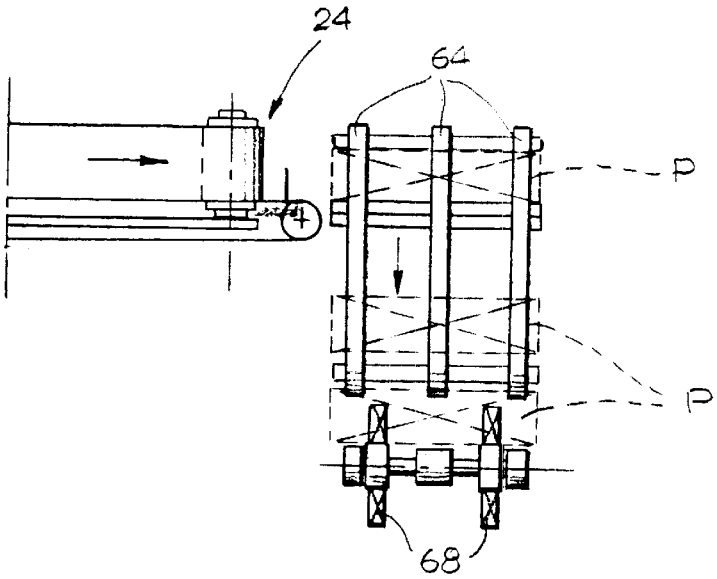
FIG. 8 is a schematic cross-sectional view according to the line VIII—VIII of FIG. 6.
Figure 7:
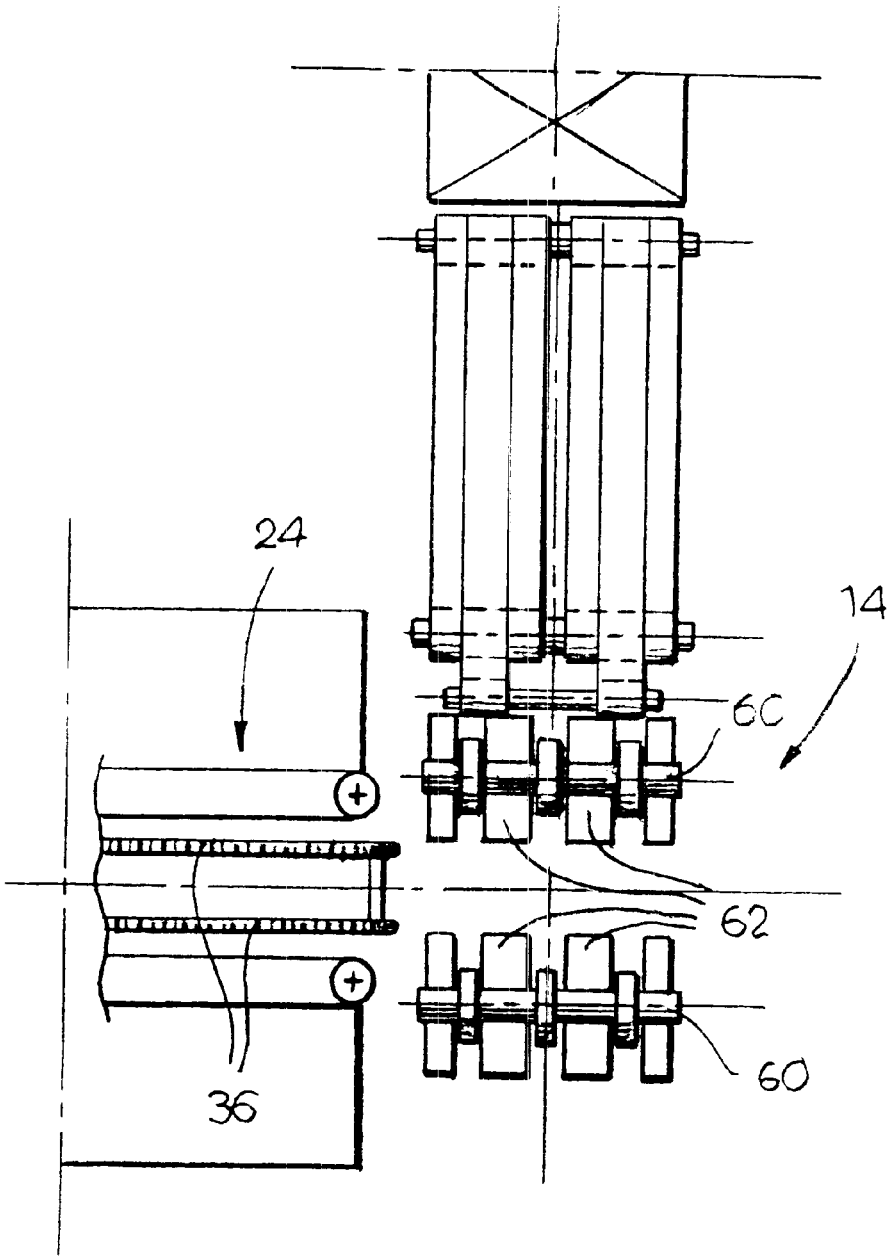
FIG. 7 is a plan view of the part indicated by the arrow VII in FIG. 6.

In the further embodiment illustrated in FIGS. 6, 7 and 8, the conveying assembly 14 comprises a pair of counter-rotating shafts 60 which carry respective supporting tabs 62 that move synchronously with the movement of advance of the packs coming from the output section 24 of the packaging machine 12. During rotation of the tabs 60, each pack drops downwards and is taken up by a pair of belts 64 (FIG. 6), which transport the individual packs P downwards and deposit them on a first conveying element 66 provided with phased pushing projections 68. The first conveying element 66 transfers the individual packs onto a second conveying element formed by opposed belts 70, 72, which take up the packs coming from the first conveying element 68 and transport them by friction towards the paddle conveyor 26 that forms part of the bagging machine 16. The second conveying element formed by the belts 70, 72 normally takes up the packs at the same rate at which they arrive but, if so required, enables accumulation in a waiting position of one or more packs P before the latter are picked up by the paddle conveyor 26.

Figure 9:
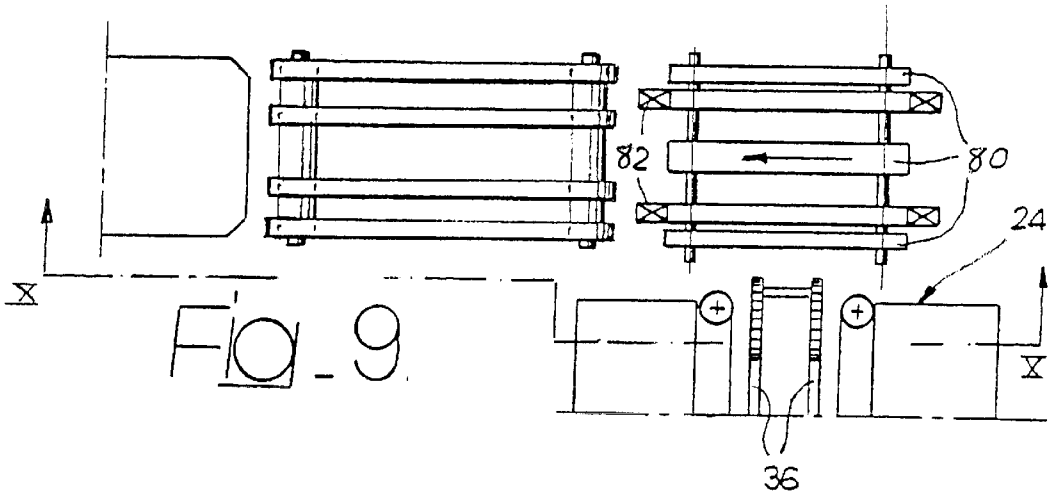
FIG. 9 is a schematic plan view illustrating a fourth embodiment of an intermediate conveyor according to the present invention.
Figure 10:
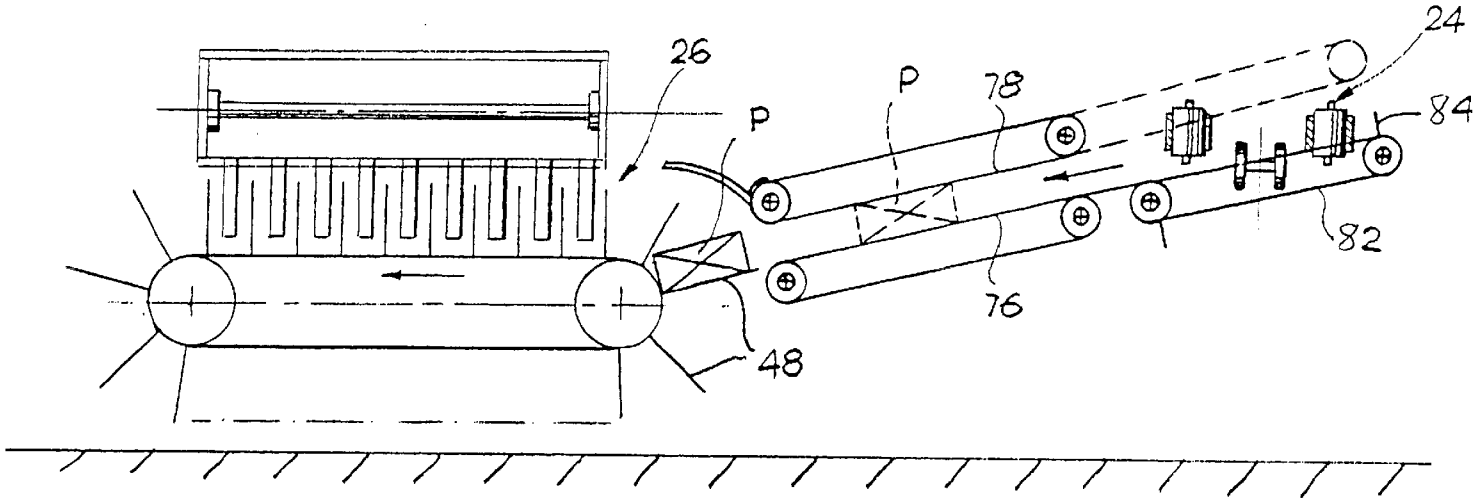
FIG. 10 is a schematic cross-sectional view according to the line X—X of FIG. 9.

FIGS. 9 and 10 illustrate a fourth embodiment of the present invention. In this further embodiment, as usual the packs P arrive sequentially from the output section 24 of the packaging machine 12. The packs are transferred onto the conveying assembly 14, where they are supported by slats 80 which form a surface inclined downwards and co-operate with conveyor belts 82 provided with phased projections 84 that are synchronized with the sequence of output of the packs from the output section 24. The inclined conveyor formed by the slats 80 and belts 82 transfers the individual packs onto a second conveying element formed by bottom belts 76 and top belts 78 which convey by friction the individual packs towards the paddle conveyor 48, which, in normal conditions, takes up the packs at the same rate at which they arrive. The second conveying element formed by the belts 76, 78 can enable accumulation of one or more packs before the latter are picked up by the paddle conveyor 26.

What is claimed is:

1. A plant for packaging and bagging rolls of paper, comprising:

a packaging machine including:

a feed assembly for feeding rolls of paper;

a feed assembly for feeding films of packaging material; and an assembly for the formation of packs, in which a portion of film of plastic material is wrapped around one or more rolls and is closed by folding and welding of the film, the pack-formation assembly having an output section from which the packaged rolls exit sequentially according to a pre-set rate;

a bagging machine including:

an assembly for receiving the products, which is designed to receive the packs coming from the packaging machine and to form successive rows of packs, each of which is made up of a pre-set number of packs;

an elevator device designed to receive successive layers, each of which is made up of one or more rows of packs; and a bagging assembly designed to insert one or more layers of packs into a partially closed bag of packaging material and designed to close the bag of packaging material after insertion of said layers, wherein set between the packaging machine and the bagging machine is a conveying assembly which operates in a cadenced way together with the packaging machine (12) and the bagging machine, wherein the conveying assembly comprises at least one first conveying element and at least one second conveying element, said first conveying element being provided with pushing means for positive drawing along of the products, and said second conveying element is designed to carry out conveyance by friction of the packs with the possibility of accumulating a small number of packs upstream of the bagging machine.

* * * * *